US006431381B1

(12) United States Patent
Randall

(10) Patent No.: US 6,431,381 B1
(45) Date of Patent: Aug. 13, 2002

(54) POSITIVE ORIENTATION SYSTEMS FOR CLOSURES AND CONTAINERS

(75) Inventor: Jeffrey T. Randall, Oconomowoc, WI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 0 days.

(21) Appl. No.: 09/686,289

(22) Filed: Oct. 11, 2000

(51) Int. Cl.[7] ..... B65D 47/08
(52) U.S. Cl. ..... 215/331; 215/235
(58) Field of Search ..... 215/330, 331, 215/235, 237

(56) References Cited

U.S. PATENT DOCUMENTS

| | | | |
|---|---|---|---|
| 133,518 | A | 12/1872 | Burnap |
| 563,667 | A | 7/1896 | Hoffman |
| 911,485 | A | 2/1909 | Fitzgerald |
| 929,485 | A | 7/1909 | Plunkett |
| 1,459,589 | A | 6/1923 | Hoffman |
| 1,499,612 | A | 7/1924 | Hammer |
| 1,516,046 | A | 11/1924 | Lee |
| 1,669,579 | A | 5/1928 | Scofield |
| 1,849,523 | A | 3/1932 | Hammer |
| 1,858,163 | A | 5/1932 | De Boissac |
| 2,045,388 | A | 6/1936 | Guthrie |
| 2,063,157 | A | 12/1936 | Gray |
| 2,072,873 | A | 3/1937 | Fusting et al. |
| 2,153,426 | A | 4/1939 | McNamara et al. |
| 2,168,594 | A | 8/1939 | Von Till |
| 2,264,792 | A | 12/1941 | Gray et al. |
| 2,423,295 | A | 7/1947 | Crabbe et al. |
| 2,733,052 | A | 1/1956 | Luther |
| 2,822,104 | A | 2/1958 | Busch |
| 3,101,856 | A | 8/1963 | Whiteman, Jr. |
| 3,110,410 | A | 11/1963 | Pehr |
| 3,339,773 | A | 9/1967 | Stull |
| 3,435,978 | A | 4/1969 | Wittwer |
| 3,511,403 | A | 5/1970 | Braun |
| 3,612,324 | A | 10/1971 | Malick |
| 3,716,161 | A | 2/1973 | Jullian et al. |
| 3,805,987 | A | 4/1974 | Horvath |
| 3,809,276 | A | 5/1974 | Landen |
| 3,831,797 | A | 8/1974 | Stevens, Jr. |
| 3,910,444 | A | 10/1975 | Foster |

(List continued on next page.)

FOREIGN PATENT DOCUMENTS

| | | | |
|---|---|---|---|
| AT | 236822 | | 3/1964 |
| CA | 963845 | | 3/1975 |
| CH | 455545 | | 7/1968 |
| DE | 109493 | | 4/1968 |
| DE | 196 52 148 | * | 6/1998 |
| EP | 0 007 274 | | 1/1980 |
| EP | 0 011 575 | A1 | 5/1980 |
| EP | 0431 915 | A1 | 6/1991 |
| FR | 1560099 | | 2/1969 |
| FR | 77.39457 | | 7/1979 |
| FR | 90.06234 | | 11/1991 |
| GB | 225923 | | 12/1924 |
| GB | 2126565 | | 3/1984 |

*Primary Examiner*—Nathan J. Newhouse
(74) *Attorney, Agent, or Firm*—Wood, Phillips, Katz, Clark & Mortimer

(57) ABSTRACT

Positive orientation systems are provided for packages formed by the combination of a container and closure. In one embodiment, the invention provides a closure having a plug seal with at least one plug seal lug that cooperates with a container neck lug formed on a shoulder on an interior surface of the container neck. In another embodiment, at least one neck lug is provided on an end of the container neck and the closure body is provided with at least one closure deck lug extending from the closure deck and adapted to engage a corresponding one of the at least one neck lug.

3 Claims, 2 Drawing Sheets

U.S. PATENT DOCUMENTS 3,951,289 A 4/1976 Landen
3,954,200 A 5/1976 Willis
3,973,941 A 8/1976 Augeri
3,993,208 A 11/1976 Ostrowsky
4,007,848 A 2/1977 Snyder
4,036,385 A 7/1977 Morris
4,068,775 A 1/1978 Palmer
4,093,096 A 6/1978 Augros
4,098,419 A 7/1978 Virog, Jr. et al.
4,127,221 A 11/1978 Vere
4,134,513 A 1/1979 Mumford
4,144,983 A 3/1979 Pauls et al.
4,177,904 A 12/1979 Planas
4,271,974 A 6/1981 Quinard
4,273,248 A 6/1981 Lehmann
4,280,632 A 7/1981 Yuhara
4,289,248 A 9/1981 Lynn
4,310,101 A 1/1982 Sekine
4,365,721 A 12/1982 Montgomery
4,387,821 A 6/1983 Geiger
4,387,822 A 6/1983 Lynn
4,454,965 A 6/1984 Kirk, Jr.
4,456,136 A 6/1984 Pálsson
4,519,518 A 5/1985 Wiles et al.
4,597,501 A 7/1986 Gueret
4,638,918 A 1/1987 Martinez
4,645,096 A 2/1987 Grant
4,662,530 A 5/1987 Goncalves
4,669,624 A 6/1987 Wiles et al.
4,691,833 A 9/1987 Ahrens
4,747,498 A * 5/1988 Gach ..... 215/235
4,763,801 A 8/1988 Nycz
4,763,804 A 8/1988 O'Connell
4,770,308 A 9/1988 Lynn
4,781,311 A 11/1988 Dunning et al.
4,799,597 A 1/1989 Mayes et al.
4,821,899 A * 4/1989 Nycz et al. ..... 215/235
4,858,777 A 8/1989 Morel
4,913,299 A 4/1990 Petro
4,940,168 A 7/1990 Shadwell et al.
4,991,733 A 2/1991 Marino
5,133,471 A 7/1992 Almirall
5,141,347 A 8/1992 Fitjer
5,143,234 A 9/1992 Lohrmann
5,145,080 A 9/1992 Imbery, Jr.
5,150,803 A 9/1992 Cartellone
5,160,057 A 11/1992 Fitjer
5,184,741 A 2/1993 Chevassus et al.
5,186,344 A 2/1993 Cook
5,213,225 A 5/1993 King et al.
5,279,434 A 1/1994 Aguirrezabal
5,292,020 A * 3/1994 Narin ..... 215/330
5,411,157 A 5/1995 King et al.
5,454,476 A 10/1995 King et al.
5,533,633 A 7/1996 King
5,588,545 A 12/1996 King
5,676,270 A * 10/1997 Roberts ..... 215/330
5,769,254 A 6/1998 Milner et al.
5,803,287 A 9/1998 Kusz
5,806,698 A * 9/1998 Aguirrezabal ..... 215/330
5,944,208 A 8/1999 Gale
5,984,123 A 11/1999 Mogami et al.
5,992,659 A * 11/1999 Nofer et al. ..... 215/330

* cited by examiner

FIG. 1
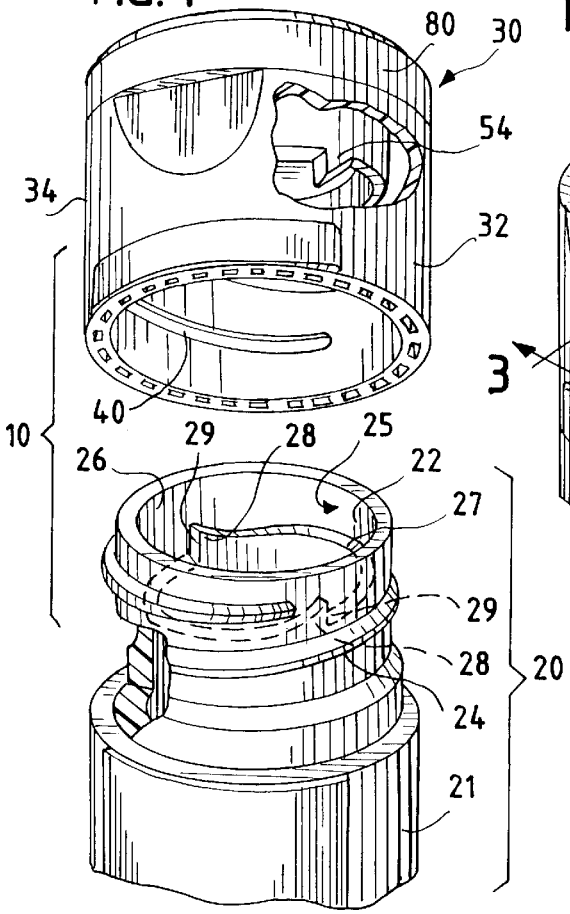
FIG. 2
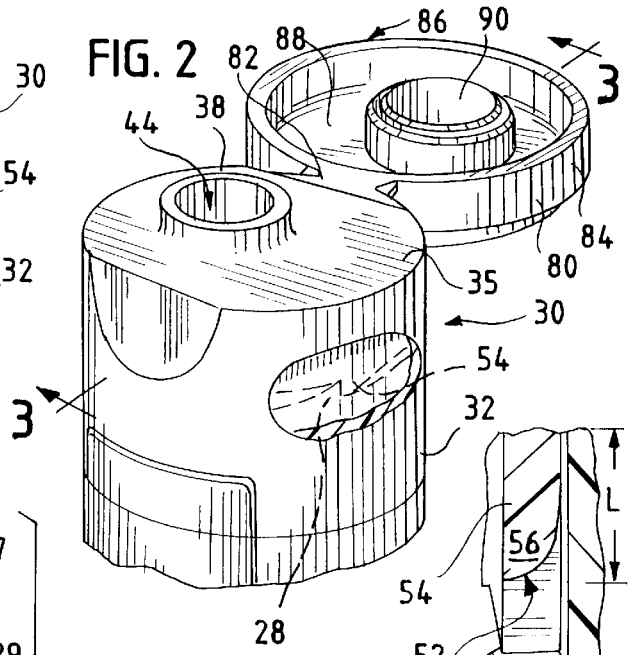
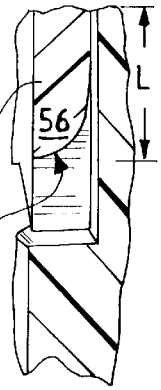
FIG. 5
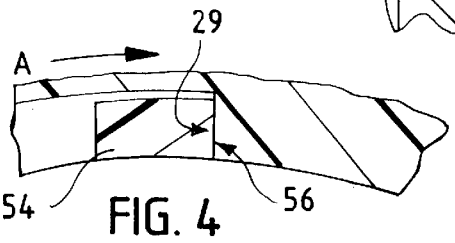
FIG. 4
FIG. 3
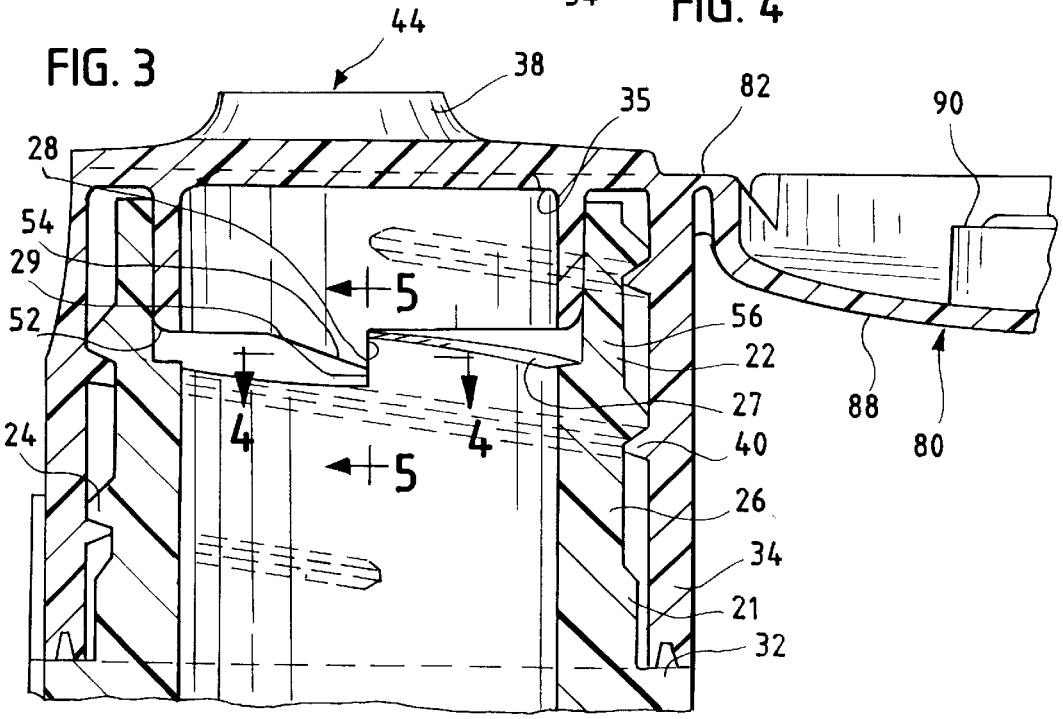

FIG. 6
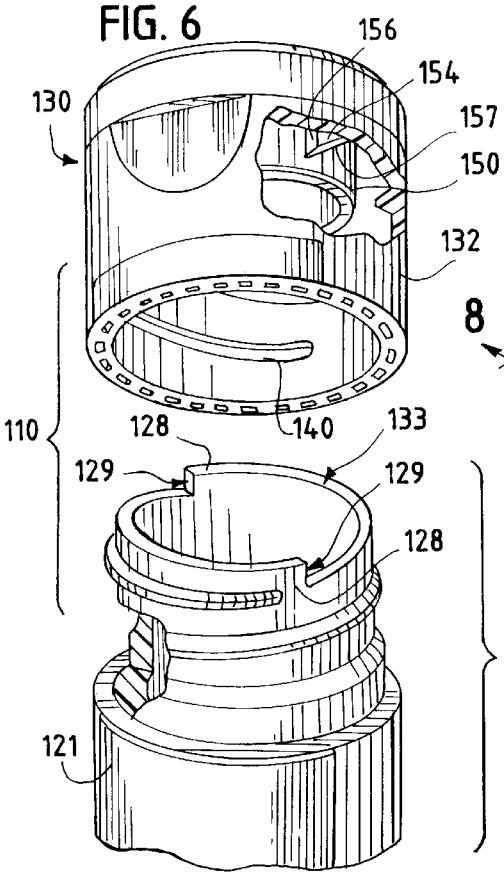
FIG. 7
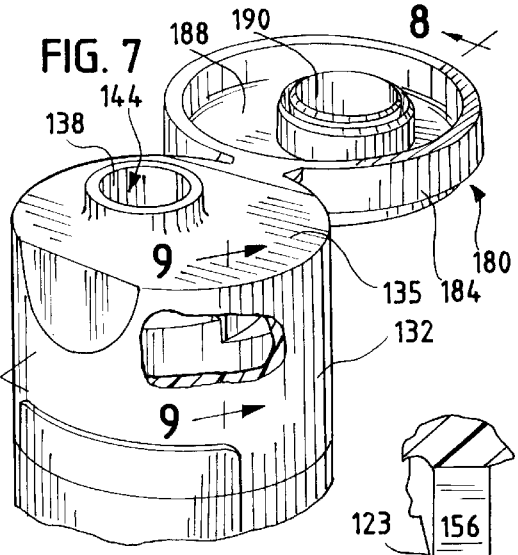
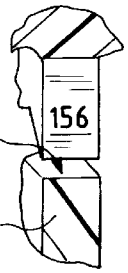
FIG. 9
FIG. 10
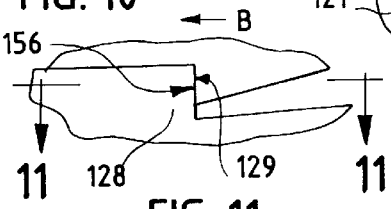
FIG. 11
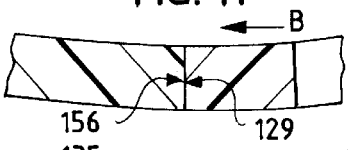
FIG. 8
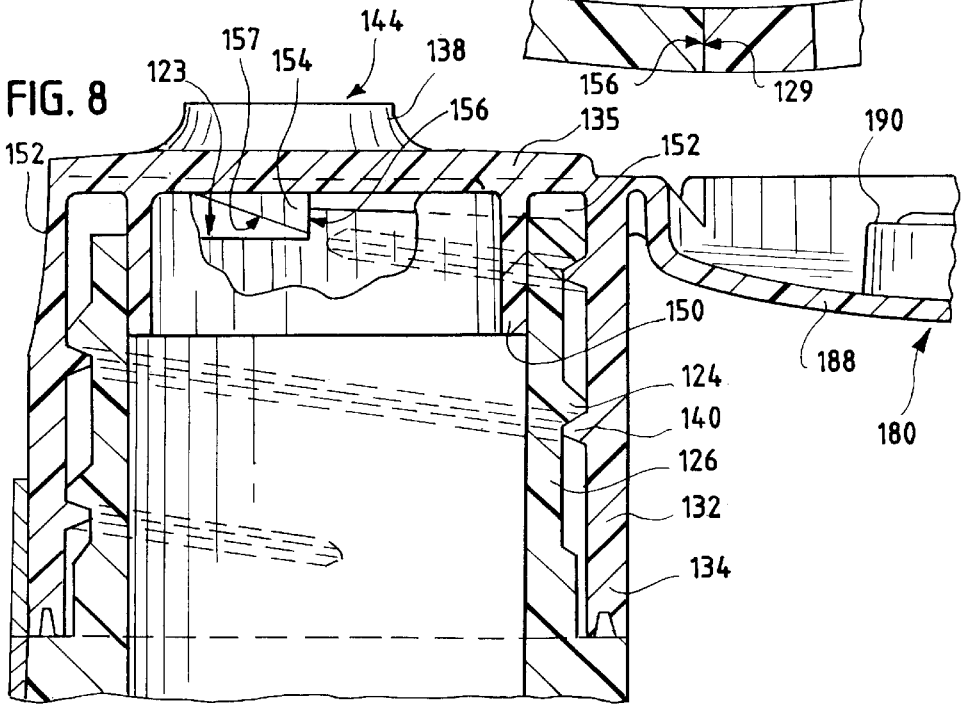

POSITIVE ORIENTATION SYSTEMS FOR CLOSURES AND CONTAINERS

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to closure assemblies and to packages in the form of a combination of a container and a closure assembly for the container. More particularly, the invention relates to closure assemblies and packages that provide positive-orientation of the closure assembly relative to the container.

BACKGROUND OF THE INVENTION AND TECHNICAL PROBLEMS POSED BY THE PRIOR ART

Positive orientation systems for packages in the form of a container and a closure assembly for the container are generally known in the prior art. For example, U.S. Pat. No. 5,145,080, the subject matter and entire writing of which is incorporated herein by reference, discloses a closure assembly that includes a closure body having a closure skirt with one or more recesses on an interior surface of the closure skirt. The closure assembly is adapted to engage a container neck finish that includes a threaded container neck with protuberances formed on a base portion thereof. Each recess is adapted to receive a protuberance. As the closure is rotated and threaded onto the container neck, the closure skirt is initially engaged by and deformed somewhat by the protuberances. Either the container neck or the closure skirt, or both, must be sufficiently resilient to deform as the closure is threaded onto the container neck so as to accommodate relative movement of the protuberance and skirt until the protuberance is received in the recess. When the recesses become aligned with the protuberances, the container skirt or protuberance, or both, return to their undeformed shape, thereby retaining the closure in a predetermined orientation on the container.

Positive-orientation systems of the prior art are characterized by a number of disadvantages. For example, systems such as those described above require that the closure skirt have a wall thickness that is sufficient to accommodate the formation of recesses. On the other hand, such closures require the closure body skirt wall or the protuberance, or both, to be of such dimension to permit deformation without requiring undue rotational force. Thus, the positive orientation features of prior art closure systems impose limitations on the dimensional characteristics of the closure body skirt wall and on the container neck finish protuberances and associated limitations on the manufacturing techniques and aesthetic appearance of closure assemblies.

It would therefore be desirable to provide a positive orientation system in the form of a closure and container combination that avoid these limitations. It would also be advantageous if such an improved closure system could accommodate bottles, containers, or packages which have a variety of shapes and that are constructed from a variety of materials. Further, it would be desirable if such an improved system could accommodate efficient, high-quality, large volume manufacturing techniques with a reduced product reject rate to produce a system with consistent operating characteristics.

BRIEF SUMMARY OF THE INVENTION

The benefits and advantages described above are realized by the present invention which provides a package, including a closure and container combination having positive-orientation features which do not require deformation during installation and which therefore eliminate the limitations imposed by prior art positive orientation systems.

In a broad sense, the invention comprises a positive orientation container and closure combination comprising: (A) a container defining an interior and having a neck defining an opening to the interior, the neck having at least one male neck thread with a predetermined root diameter; (B) a closure cooperatively associated with the container neck for closing the opening, the closure comprising a deck, a skirt extending from the deck and having at least one female skirt thread for threadingly engaging the neck thread; and (C) an orientation structure on said closure and an orientation structure on said container for engaging said orientation structure on said closure to establish a positive orientation of the closure in an installed position relative to the container, said orientation structure on said container being located within the container male neck thread root diameter and being operable without deformation of the closure as the closure is screwed on to the container neck.

In one preferred embodiment, the invention provides a closure having a plug seal with at least one plug seal lug that cooperates with a container neck lug formed on a shoulder on an interior surface of the container neck. This aspect of the invention may be defined as a positive orientation container and closure combination comprising: (A) a container body defining an interior and having a neck including an interior neck surface and defining an opening to the interior, the neck having at least one neck thread and at least one container neck lug extending from the interior neck surface, the at least one container neck lug having a container neck lug abutment surface; and (B) a positive-orientation closure cooperatively associated with the container neck for closing the opening, the closure including: (1) a closure deck, (2) a skirt extending from the deck and having at least one skirt thread formed thereon for threadingly engaging the at least one neck thread, (3) a plug seal extending from the deck for sealingly engaging an interior surface of the neck, and (4) at least one plug seal lug formed on the plug seal and adapted to engage the at least one container neck lug abutment surface when the closure is rotated to an installed position to thereby positively orient the closure with respect to the container. As the closure is screwed onto the container neck, the at least one plug seal abutment surface eventually engages the at least one neck lug abutment surface to prevent further rotation of the closure relative to the container and thereby defines an installed position in which the closure is positively oriented relative to the container.

In another preferred embodiment, at least one neck lug is provided on an end of the container neck and the closure body is provided with at least one closure deck lug extending from the closure deck and adapted to engage a corresponding one of the at least one neck lug. This feature of the invention may be defined as a positive-orientation container and closure combination comprising: (A) a container body defining an interior and having a neck defining an opening to the interior, the neck having (1) at least one neck thread formed thereon, (2) a neck end surface extending around the opening, and (3) at least one neck lug extending from the end surface; and (B) a positive-orientation closure rotatably cooperating with the container neck for closing the opening, the closure including: (1) a closure deck; (2) a skirt extending from the closure deck and having at least one skirt thread formed thereon for threadingly engaging the at least one neck thread; and (3) at least one closure deck lug extending from the closure deck and adapted to engage a corresponding one of the at least one neck lug when the closure is rotated to an installed position to thereby positively orient the closure with respect to the container. As the closure is screwed onto the container neck, the closure deck lug eventually engages the neck lug to prevent further rotation of the closure relative to the container and thereby define an installed position in which the closure is positively oriented relative to the container.

The novel positive orientation features provided by the invention can easily be provided in closures and containers manufactured by injection molding of thermoplastic materials. These features permit positive-orientation without undue limitations on the dimensions of the closure skirt and without requiring the relatively complicated manufacturing steps associated with the formation of protuberances extending from the base of the container neck.

Numerous other advantages and features of the present invention will become readily apparent from the following detailed description of the invention, from the claims, and from the accompanying drawings.

BRIEF DESCRIPTION OF THE DRAWINGS

The accompanying drawings form part of the specification, and like numerals are employed to designate like parts throughout the same.

In the accompanying drawings that form part of the specification, and in which like numerals are employed to designate like parts throughout the same, FIG. 1 is a fragmentary, exploded, perspective view of an exemplary closure and container assembly according to a preferred embodiment of the present invention;

FIG. 2 is a fragmentary, perspective view of the closure and container of FIG. 1 with the closure mounted on the container and with the closure lid in an opened position;

FIG. 3 is an enlarged, fragmentary, cross-sectional view taken generally along the plane 3—3 in FIG. 2;

FIG. 4 is an enlarged, fragmentary, cross-sectional view taken generally along the plane 4—4 in FIG. 3;

FIG. 5 is an enlarged, fragmentary, cross-sectional view taken generally along the plane 5—5 in FIG. 3;

FIG. 6 is a fragmentary, exploded, perspective view of an exemplary closure and container assembly according to another preferred embodiment of the present invention;

FIG. 7 is a fragmentary, perspective view of the closure and container of FIG. 6 with the closure mounted on the container and with the closure lid in an opened position;

FIG. 8 is an enlarged, fragmentary, cross-sectional view taken generally along the plane 8—8 in FIG. 7;

FIG. 9 is an enlarged, fragmentary, cross-sectional view taken generally along the plane 9—9 in FIG. 7;

FIG. 10 is an enlarged, fragmentary, side view of exemplary first and second abutment surfaces of the embodiment shown in FIG. 7; and FIG. 11 is a fragmentary, cross-sectional view taken generally along the plane 11—11 in FIG. 10.

DETAILED DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, most of the figures illustrating the invention show a positive orientation system in the typical orientation that it would have at the top of a container when the container is stored upright on its base, and terms such as upper, lower, horizontal, etc., are used with reference to this position. It will be understood, however, that the positive orientation systems of this invention may be manufactured, stored, transported, used, and sold in an orientation other than the position described.

Some of the positive-orientation systems provided by this invention include closures which are intended for use with threaded containers having a special finish configuration, while some other systems of the invention are suitable for use with threaded containers having a conventional finish.

As used herein, the term "neck" is intended to mean any part of a container in which threads or other fastening means for a closure are formed or defined. The term "neck" is not necessarily limited to a container part which is of a reduced diameter or reduced lateral dimension compared to the container body. Thus, a container which has a threaded portion that is of an equal or similar width or diameter to the container body will also be considered to have a "neck" in accord with the definition used herein.

Some of the figures illustrating the preferred embodiment of the container and closure show conventional structural details and features that will be recognized by one skilled in the art. However, a detailed description of such details and features are not necessary for an understanding of the invention, and accordingly, are not herein presented.

With reference to FIGS. 1–5, an exemplary positive-orientation system is illustrated in a package, generally designated with the number 10 and comprising a container 20 and a closure 30. Those of ordinary skill will recognize that FIG. 1 illustrates only the neck portion of the container 20. The container 20 typically includes a body portion or receptacle portion (not visible in the figures) which may have any suitable special or conventional configuration and from which neck 21 extends to receive the closure 30. The container neck 21 includes a neck finish having at least one male thread 24 form on an outer surface thereof. The bottom or root of the thread form (i.e., the innermost radial extent of the thread on the container neck) defines a predetermined minor diameter or root diameter.

According to the present invention, features of a novel positive orientation system are provided on the container neck 21 and the closure 30 for establishing a predetermined orientation of the closure 30 relative to the container 21 when they are assembled together. In particular, the container neck 21 is provided with an orientation structure, such as at least one container neck lug 28, and preferably a pair of container neck lugs 28, which extend from a container neck shoulder 27 (FIG. 1) formed on the interior of the container neck 21 and which extend from an interior surface 25 of the container neck wall 26. The shoulder 27 defines a smaller diameter portion of the neck 21 and an enlarged diameter plug-receiving portion 22. The container neck lugs 28 are preferably spaced about 180 degrees apart, and each have a generally vertically extending container neck lug abutment surface 29 for engaging a respective plug seal lug 54 formed on the closure 30 as will be described below. The lugs 28 are preferably located within the container neck within the container thread root diameter.

The closure 30 includes a closure body 32 which is of a generally cylindrical shape and which includes a closure skirt 34 that extends downward from substantially planar closure deck 35. A female thread 40 (FIGS. 1 and 3) is formed on an interior surface of the closure skirt 34. The closure deck 35 includes a spout 38 which defines a dispensing orifice 44 for permitting flow of contents from the container 20. The closure body 32 also includes a plug seal 50 extending downward from the closure deck 35 and having a rounded end surface 52 (FIGS. 3 and 5) to permit ease of insertion of the plug seal into the enlarged diameter portion 22 of the container neck 21.

A lid 80 is pivotally attached to the closure body 32 by a hinge 82 and includes a lid sidewall or skirt 84 which extends to a lid seating surface 86 from a lid end wall 88. In the illustrated preferred embodiment, the lid 80 is connected to the closure body by a suitable means, such as a snap-action hinge 82. Such a snap-action hinge 82 is formed integrally with the closure body 32 and lid 80. The snap-action hinge 82 may be a conventional or special type such as described in the U.S. Pat. No. 4,403,712 or U.S. Pat. No. 5,642,824. The lid 80 includes an internal spud or ring seal 90 for entering into and sealing the dispensing orifice 44. The lid 80 is adapted to be moved between an open position (FIGS. 2 and 3) for permitting the dispensing of the container contents and a closed position (FIG. 1) in which the dispensing orifice 44 (FIG. 2) is occluded. In an alternate embodiment (not illustrated), the hinge 82 could be omitted, and the lid 80 may be completely removable from the closure body 32.

Preferably, the closure body 32, lid 80, and hinge 82 are molded as a unitary structure from suitable thermoplastic materials compatible with the container and its contents. The details of the particular hinge structure, lid structure, and closure body deck structure form no part of the present invention. The closure 30 may include other dispensing features instead of the spout 38 and dispensing orifice 44. For example, a special discharge structure, such as a nozzle, spray device, or the like may be provided. Alternatively, a plurality of dispensing orifices, or other structures for discharging the container contents, may be provided in the closure body 32. Depending upon the type of discharge structure incorporated, the full lid 80 may be entirely eliminated.

In accordance with the positive-orientation features of the invention, the plug seal 50 is provided with an orientation structure, such as one, or preferably two plug seal lugs 54 about 180 degrees apart (only one plug seal lug 54 being visible in the figures), each having a plug seal lug abutment surface 56 for engaging a respective container neck lug abutment surface 29. As FIG. 3 illustrates, when the closure body 32 is screwed onto the container neck 21 in a clockwise direction as viewed from above, the plug seal lug abutment surfaces 56 of the plug seal lugs 54 will come into eventual engagement with the container neck lug abutment surfaces 29, thereby resulting in a positive orientation of the closure 30 relative to the container 20. FIG. 4 illustrates a cross-sectional view taken along line 4—4 in FIG. 3 and shows one of the plug seal abutment surfaces 56 engaging one of the neck lug abutment surfaces 29 and resisting further rotation of the closure 30 in the direction of arrow (A). FIG. 5 is a cross-sectional view taken along line 5—5 in FIG. 3 and shows the rounded end surface 52 of the plug seal 50 and the axial extent (L) of one of the plug seal lugs 56. As will be recognized, the axial extent (L) of the plug seal lugs 56 and their radial position on the plug seal are selected, dependent upon the slope of the neck thread 24 and, therefore, the slope of the closure skirt thread 40, to permit maximal engagement of the plug seal lugs 54 with the container neck lugs 28.

With reference to FIGS. 6–11, another exemplary positive-orientation system is illustrated in a package, generally designated with the number 110 and comprising a container 120 and the closure 130. In this embodiment, an orientation structure is provided on the underside of the closure deck and includes, in the illustrated preferred form, a pair of closure deck lugs 154 in an annular space 152 (FIG. 3) between the plug seal 150 and closure body skirt 134 of the closure body 132. In this embodiment, the container 120 includes a container neck 121 having a container neck end surface 123. An orientation structure is provided in the container neck, and in the illustrated preferred form, the orientation structure comprises a pair of neck lugs 128 which extend from the container neck end surface 123. Each lug 128 includes a generally vertical neck lug abutment surface 129. Each closure deck lug 154 is adapted to engage a respective one of the two neck lugs 128 extending from the neck end surface 123.

The container neck 121 includes a neck finish having at least one male thread 124 or thread form on an outer surface thereof. The bottom or root of the thread form (i.e., the innermost radial extent of the thread 124 on the container neck 121) defines a predetermined minor diameter or root diameter. The container neck lugs 128 are preferably located within the predetermined root diameter of the container neck thread 124. That is, the container neck lugs 128 do not extend radially outward on the wall of the container neck 121 beyond the root of the neck thread 124.

The closure 130 includes a closure body 132 having a closure skirt 134 extending from a closure deck 135 which has a spout 138 defining a dispensing orifice 144. A female thread 140 is formed on an interior surface of the closure skirt 134 for engaging the container neck thread 124. As best seen in the cutaway shown in FIG. 6 and the cross-section shown in FIG. 8, the plug seal 150 extends from the closure deck 135, and the annular space 152 is defined between an exterior surface of the plug seal 150 and an interior surface of the closure skirt 134. In accordance with the invention, the closure deck lugs 154 are located in the annular space 152, and each includes a closure deck lug abutment surface 156. The closure body lugs 154 function to engage the neck lugs 128 when the closure body 132 is rotated to an installed position shown in FIGS. 7 and 8. The abutment surfaces 129 formed on the neck lugs 128 are engaged by the abutment surfaces 156 formed on the closure body plug lugs 154 to prevent further rotation of the closure body 130 relative to the container 120.

The closure 130 also includes a lid 180 which is pivotally connected to the closure body 132 by a snap action hinge 182. The lid 180 includes a lid sidewall 184, a lid seating surface 186, and a lid end wall 188. An orifice sealing member 190 is provided on the lid end wall 188.

FIG. 9 is a cross-sectional view taken along lines 9—9 in FIG. 7 and shows the orientation of one of the closure deck lug abutment surfaces 156 relative to the container neck end surface 123. FIG. 10 is a fragmentary view illustrating the abutment of one of the closure deck abutment surfaces 156 with one of the neck lug abutment surfaces 129, thereby preventing further movement of the closure deck lug 154 in the direction of arrow (B). FIG. 11 is a cross-sectional view taken along lines 11—11 in FIG. 10 and shows the engagement of the closure deck lug abutment surface 156 with the neck lug abutment surface 156 as viewed from above.

The present invention contemplates that the closure 30 or 130 includes one or more features that are to be aligned in a particular orientation relative to the container 20 or 120, respectively. Such features may be include a dispensing orifice. Alternatively, such a feature could also be a particular thumb or finger grip area on the closure that is intended to be grasped in a particular orientation relative to the container. If the closure includes a lid, it may be desired to orient the hinge part of the lid relative to one side of the container—especially if the container has a non-cylindrical shape. With a container of the type that has a non-cylindrical configuration, such as one with flat sides and/or special gripping regions, it may be desirable to insure that the lid, when opened, will have an orientation relative to the container that will not inhibit the pouring or dispensing of the contents from the container.

Finally, it may be desirable to orient the closure on the container for reasons unrelated to the closure dispensing structure and/or lid. For example, the closure may be molded with an unusual external configuration for aesthetic or trade dress reasons, and it may be desired to ensure that such a closure is mounted in a particular orientation relative to the container. Alternatively, the closure may include preprinted text or graphic materials for which a particular orientation relative to the container is desired.

It will be readily apparent from the foregoing detailed description of the invention and from the illustrations thereof that numerous variations and modifications may be effected without departing from the true spirit and scope of the novel concepts and principles of this invention.

What is claimed is:

1. A positive orientation container and closure combination comprising:

(A) a container defining an interior and having a neck defining an opening to the interior, the neck having at least one male neck thread with a predetermined root diameter;

(B) a closure cooperatively associated with the container neck for closing the opening, the closure comprising (1) a deck, (2) a skirt extending from the deck and having at least one female skirt thread for threadingly engaging the neck thread; and (C) an orientation structure on said closure and an orientation structure on said container for engaging said orientation structure on said closure to establish a positive orientation of the closure in a fully closed installed position relative to the container and prevent further screwing on of the closure beyond the fully closed installed position said orientation structure on said container being (1) separated form said container male neck thread, (2) located entirely within the container male neck thread root diameter, and (3) operable without deformation of the closure as the closure is screwed on to the container neck, the engagement of said orientation structures preventing further threading engagement during installation but permitting unthreading removal of said closure from said container.

2. A positive orientation container and closure combination comprising:

(A) a container body defining an interior and having a neck including an interior neck surface and defining an opening to the interior, the neck having at least one neck thread and at least one container neck lug extending from the interior neck surface, the at least one container neck lug having a container neck lug abutment surface; and (B) a positive-orientation closure cooperatively associated with the container neck for closing the opening, the closure including: (1) a closure deck, (2) a skirt extending from the deck and having at least one skirt thread formed thereon for threadingly engaging the at least one neck thread, (3) a plug seal extending from the deck for sealingly engaging an interior surface of the neck, and (4) at least one plug seal lug formed on the plug seal and adapted to engage the at least one container neck lug abutment surface when the closure is rotated to an installed position to thereby positively orient the closure with respect to the container.

3. A positive-orientation container and closure combination comprising:

(A) a container body defining an interior and having a neck defining an opening to the interior, the neck having (1) at least one neck thread formed thereon, (2) a neck end surface extending around the opening, and (3) at least one neck lug extending from the end surface; and (B) a positive-orientation closure rotatably cooperating with the container neck for closing the opening, the closure including: (1) a closure deck; (2) a skirt extending from the closure deck and having at least one skirt thread formed thereon for threadingly engaging the at least one neck thread; and (3) at least one closure deck lug extending from the closure deck and adapted to engage a corresponding one of the at least one neck lug when the closure is rotated to an installed position to thereby positively orient the closure with respect to the container, the engagement of said orientation lugs preventing further threading engagement during installation but permitting unthreading removal of said closure from said container.

* * * * *